US005468935A

United States Patent [19]

Wang

[11] Patent Number: 5,468,935

[45] Date of Patent: Nov. 21, 1995

[54] L-ELECTRIC CONVENTIONAL ROASTER OVEN WITH WHIRLPOOL AIR CIRCULATION

[76] Inventor: Ching-Hsiang Wang, No. 9, Lane 110, Sec. 4, Si-Men Road, Tainan, Taiwan

[21] Appl. No.: 360,256

[22] Filed: Dec. 10, 1994

[51] Int. Cl.[6] ..... F27D 7/04; A21B 1/26

[52] U.S. Cl. ..... 219/400; 126/21 A

[58] Field of Search ..... 219/400, 401, 219/681; 126/20, 21 A; 99/474, 475, 476

[56] References Cited

U.S. PATENT DOCUMENTS

| | | | |
|---|---|---|---|
| 1,986,088 | 1/1935 | Wild | 219/400 |
| 2,461,318 | 2/1949 | Folli | 219/400 |
| 4,426,793 | 1/1984 | Kuboyama | 219/400 |
| 4,512,327 | 4/1985 | Stiegler | 126/21 A |
| 4,626,661 | 12/1986 | Henke | 219/400 |

*Primary Examiner*—Philip H. Leung

[57] ABSTRACT

A roaster oven with whirlpool circulation comprising an oven housing and a whirlpool circulation device, the oven housing having two heating tubes for heating up air therein, an air inlet and two air outlets in a front wall, the whirlpool circulation device having a fan, a fan housing and a power source, the fan positioned in the fan housing to be rotated by a motor in the power source to blow air in the fan housing, the fan housing having two whirlpool circulating tubes bent backward extending from the fan housing to lead hot air from the oven housing through the air net into the fan housing and then through the air outlets of the oven housing and into the oven housing to circulate as a whirlpool around an article placed in the roast chamber, for thorough and even roasting.

3 Claims, 6 Drawing Sheets

L-ELECTRIC CONVENTIONAL ROASTER OVEN WITH WHIRLPOOL AIR CIRCULATION

BACKGROUND OF THE INVENTION

This invention concerns a roaster oven with whirlpool circulation, particularly one provided with a whirlpool circulation device fixed on a front wall of an oven housing for blowing hot air generated by two heating tubes in the oven housing and forcing the hot air to circulate as a whirlpool in the oven housing so as to roast an article placed therein in a thorough and even way.

So far, most roaster ovens generally use heat transmission by means of hot air flowing in convection, comprising an electric heating tube and a blower placed under the heating tube so that hot air generated by the heating tube may be blown into the oven and circulated in a convection manner to roast an article placed in the oven. However, the convectional flow of hot air does not heat in the oven thoroughly and evenly, and thus the roasted article may not be evenly done, with places near the heating tube well done, but the farthest portion from the heating tube not well down.

One kind of roaster oven shown in FIG. 1 comprises two separating plates 10, 10 respectively at a left and a right side in the oven to form two air passageways 11. 11, and a blower 12 to cause the hot air in the oven 1 to flow into the air passageways 11, 11 and flow back in the oven 1 through another side of the oven, thus forcing the hot air to flow in a convectional way. But the temperature near the bottom of the oven is higher than the upper side thereof, and an article placed therein for roasting may get more well done at the right and the left sides than at other parts, which are neither thoroughly nor evenly done.

Another kind of roaster oven shown in. FIG. 2 comprises an air blowing device 20, which sucks hot air generated by an electric heating tube 21 out of the oven and then blows it back into an upper part of the oven for better circulation of the hot air. But an article may be roasted with its upper and lower parts well done and with the remaining parts still half done. Thus, the operation of this oven is not considered to be ideal.

SUMMARY OF THE INVENTION

This invention has an object of providing roaster oven with whirlpool circulation, and is intended to improve upon conventional roaster ovens.

The main feature of the present invention is that a front wall of a oven housing is provided with an air inlet and two air outlets near two sides of the air inlet. A whirlpool circulation device is fixed on the front wall of the oven housing so that hot air generated in the oven housing may be sucked through the air inlet and blown by a fan positioned in a fan housing of the whirlpool circulation device through two whirlpool circulating tubes of the fan housing back into the oven housing to flow in a whirlpool way therein and roast an article placed in the oven housing in a thorough and even manner. The whirlpool circulation device comprises a fan, a fan housing and a power source, with the fan positioned in the fan being housing and rotated by a motor in the power source to cause the hot air sucked in from the oven housing to circulate in an air current chamber of the fan housing, flow out of two whirlpool circulating tubes and reenter in the oven housing to circulate in a whirlpool way.

DETAILED DESCRIPTION OF THE INVENTION

Figure 1:
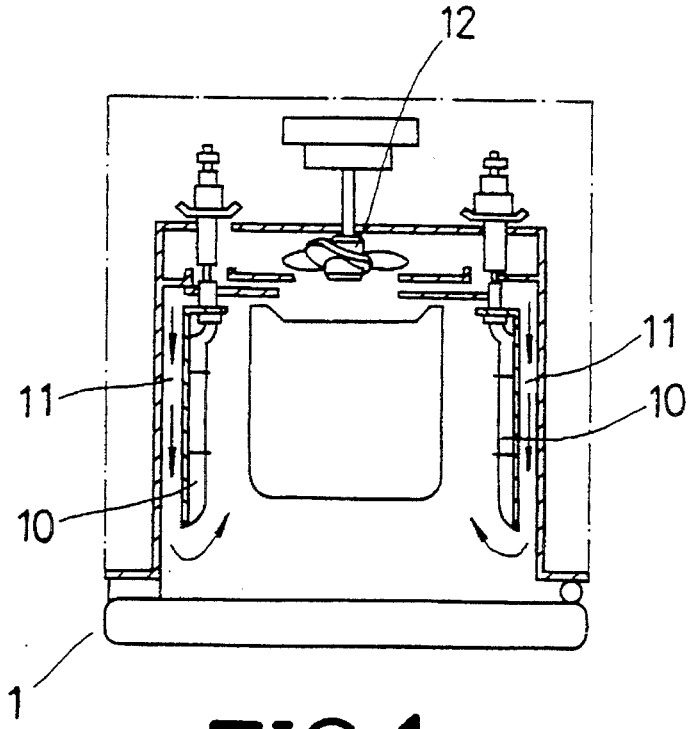
FIG. 1 (PRIOR ART)
FIG. 1 is a cross-sectional view of a known conventional roaster oven.
Figure 2:
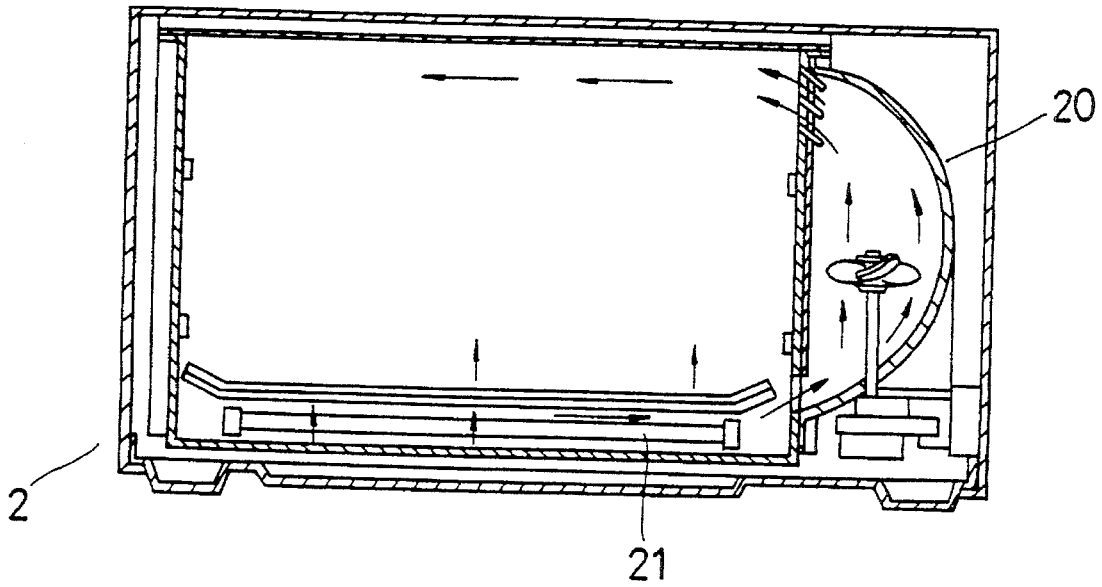
FIG. 2 (PRIOR ART)
FIG. 2 is a cross-sectional view of another known conventional oven.
Figure 3:
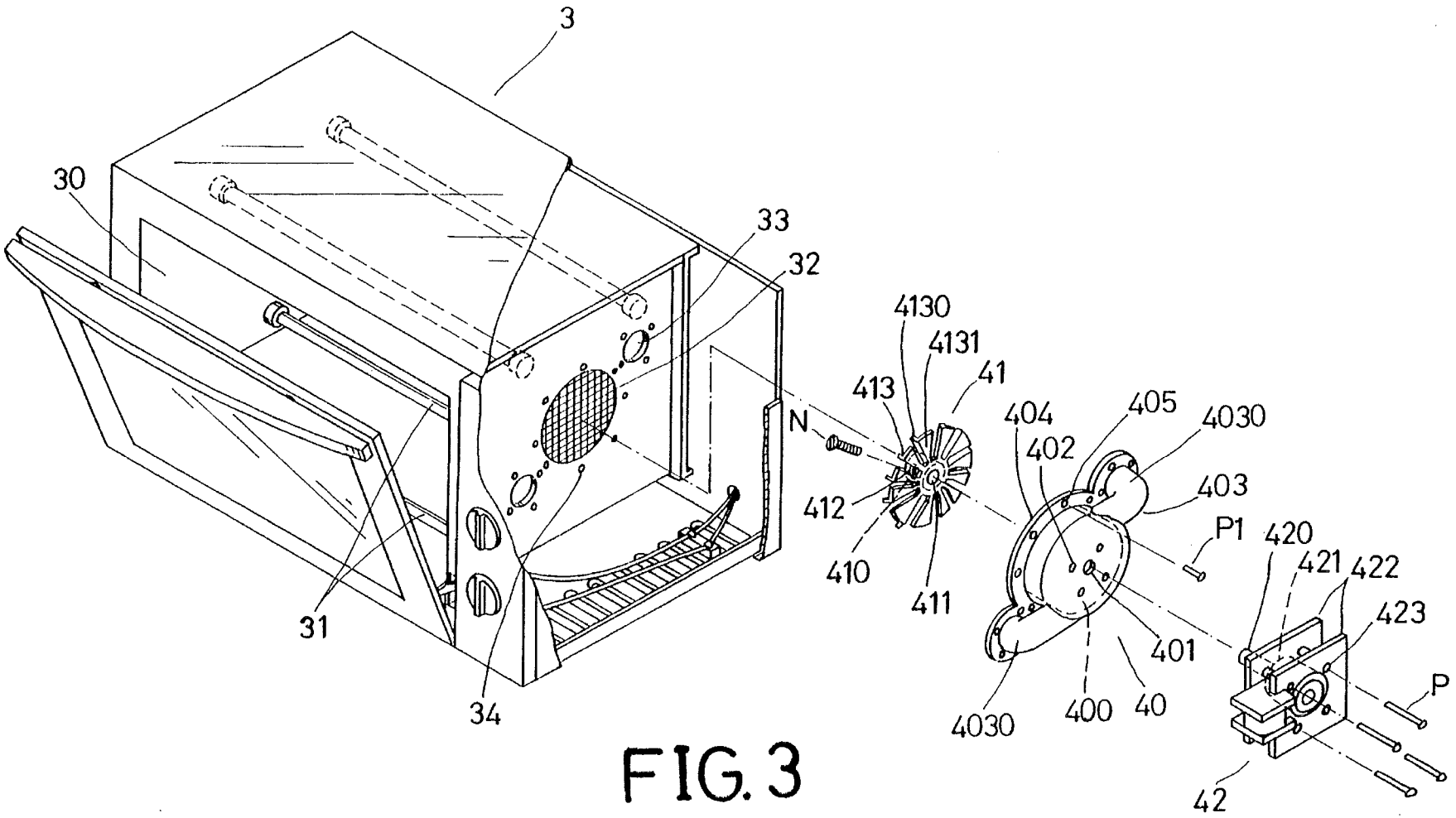
FIG. 3 is an exploded perspective view of a roaster oven with whirlpool circulation in the present invention.
Figure 4:
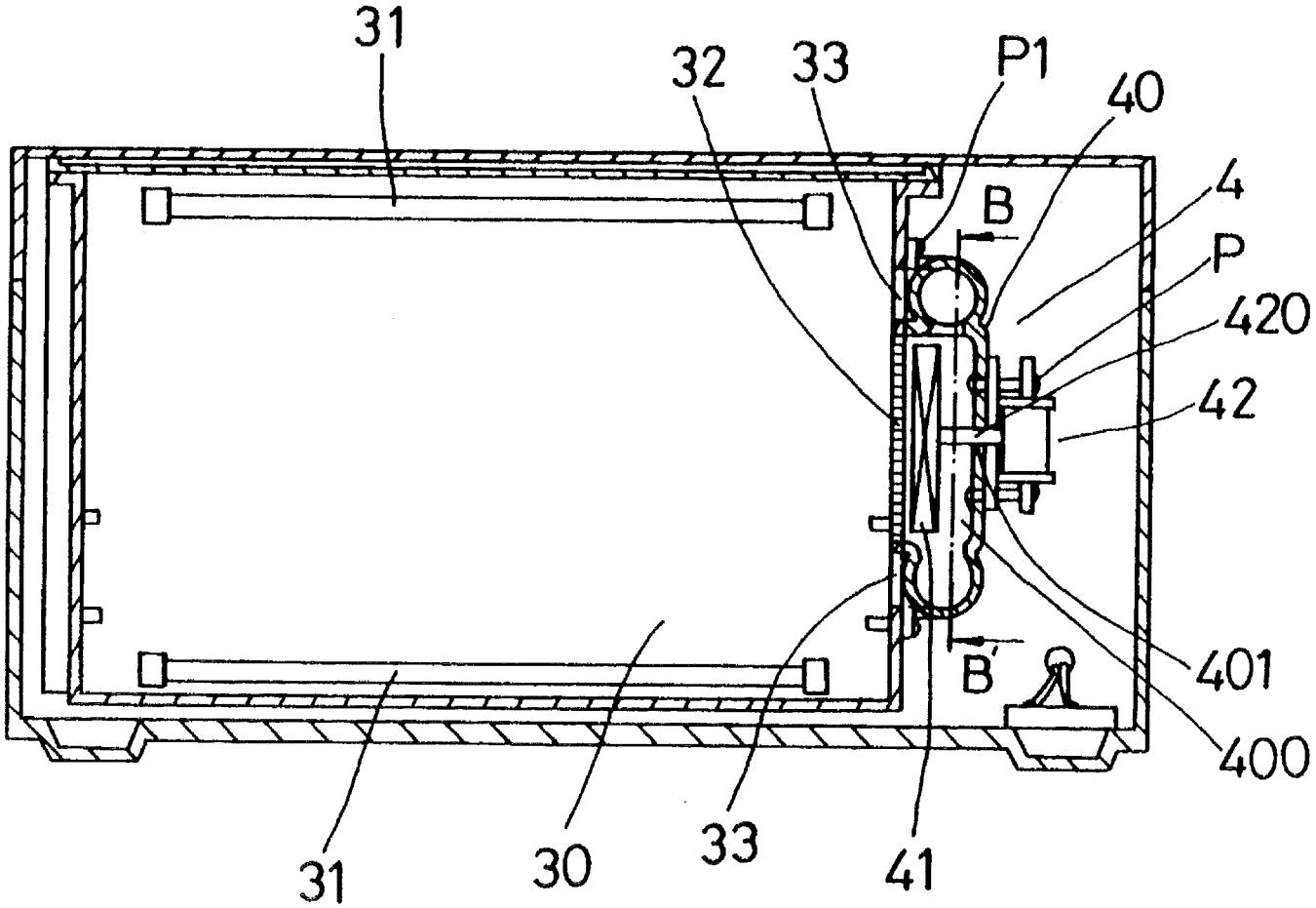
FIG. 4 is a cross-sectional view of the roaster oven with whirlpool circulation in the present invention.

A roaster oven with whirlpool circulation in the present invention, as shown in FIGS. 3 and 4 comprises an oven housing 3, and a whirlpool circulation device 4 combined together.

The oven housing 3 has a hollow roast chamber 30 defined by the housing 3, two electric heating tubes 31, 31 respectively fixed horizontally in an upper portion and a lower portion of the chamber 30, an air inlet 32 provided in a front wall of the oven housing 3, two air outlets 33, 33 respectively provided at a right upper side and at a left lower side of the air inlet 32, and several rivet holes around each of the air inlet 32 and the two air outlets 33, 33.

The whirlpool circulation device 4 comprises a fan housing 40, a fan 41 and a power source 42 combined together, being fixed with rivets into the front wall of the housing 3 over the air inlet 32, and the two air outlets 33, 33, with the rivets going through the rivet holes 34.

The fan housing 40 includes air current chamber 400 at the center portion, a shaft hole 401 at the center of a bottom wall of the chamber 400, four rivet holes 402 around the shaft hole 401 for rivets P, two whirlpool circulation tubes 403, 403 respectively provided to extend tangentially from a right upper side and a left lower side of the wall of the chamber 400, a bending portion 4030 respectively formed in-the two tubes 403, 403, a flange 404 extending around the wall of the chamber 400 and the two tubes 403, 403 and having rivet holes 405 spaced around the flanges 404.

The fan 41 is positioned in the air current chamber 400 of the fan housing 40, an includes a center shaft sleeve 410 with a center shaft hole 411, a sideway screw hole 412 and a plurality of leaves 413 extending radially from the center, each leaf 413 having an air pushing portion 4130 for pushing air and an air portion 4131 for circulating.

The power source 42 includes a motor 421, a transmitting shaft 420 with one end connected with the shaft of the motor 42 and the other end firmly fixed with the shaft sleeve 410 of the fan 41 after passing through the shaft hole 401 of the fan housing 40 and in the shaft hole 41t of the shaft sleeve 410, two supporting plates 422 provided to sustain two ends of the motor 412, and several rivet holes 423 in the two supporting plates 422.

In assembling, referring to FIGS. 3 and 4, firstly, the power source 42 of the whirlpool circulating device 4 is combined with the fan housing 40 and the fan 41, with the transmitting shaft 420 made to pass through the shaft hole 401 of the fan housing 40, through the shaft hole 410 of the fan 41 and then fixed firmly with a screw N engaging the screw hole 413 of the fan 41. After that, the power source 42 is firmly fixed together with the fan housing 40 with rivets P1 riveted after passing through the holes 423 of the power source 42 and the connecting holes 402. Then, the whirlpool circulating device 4 is combined together firmly with the housing 3 with rivets P1 riveted after passing through the flange holes 405 of the fan housing 40 and the small holes 34 around the air inlet 32 and the two air outlets 33, 33 of the front wall of the housing 3, thus finishing assemblage of this roaster oven with whirlpool circulation.

Figure 5:
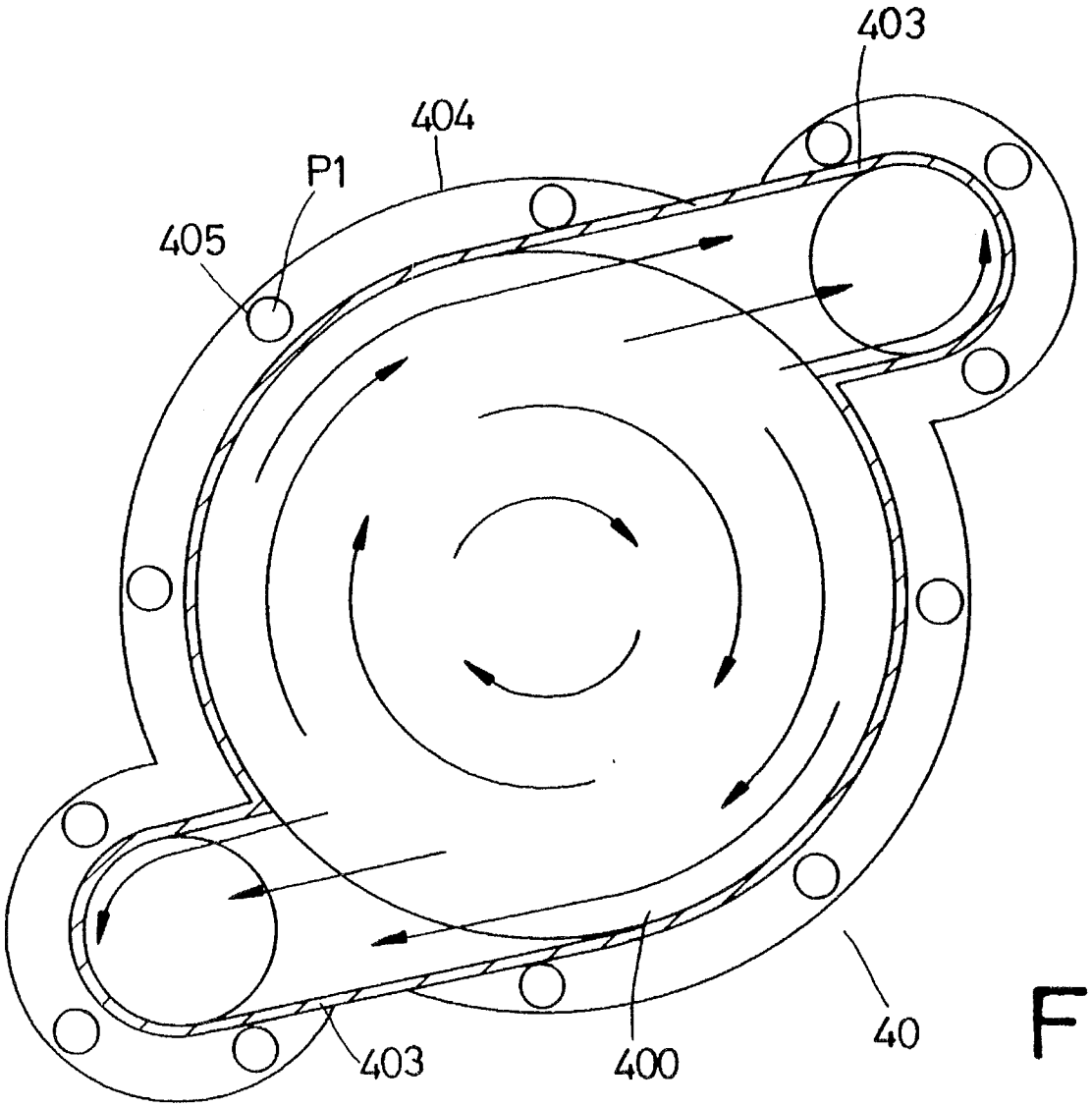
FIG. 5 is a cross-sectional view of line B—B' in FIG. 4, showing the whirlpool direction of hot air produced in the roaster oven with whirlpool circulation in the present invention.
Figure 6:
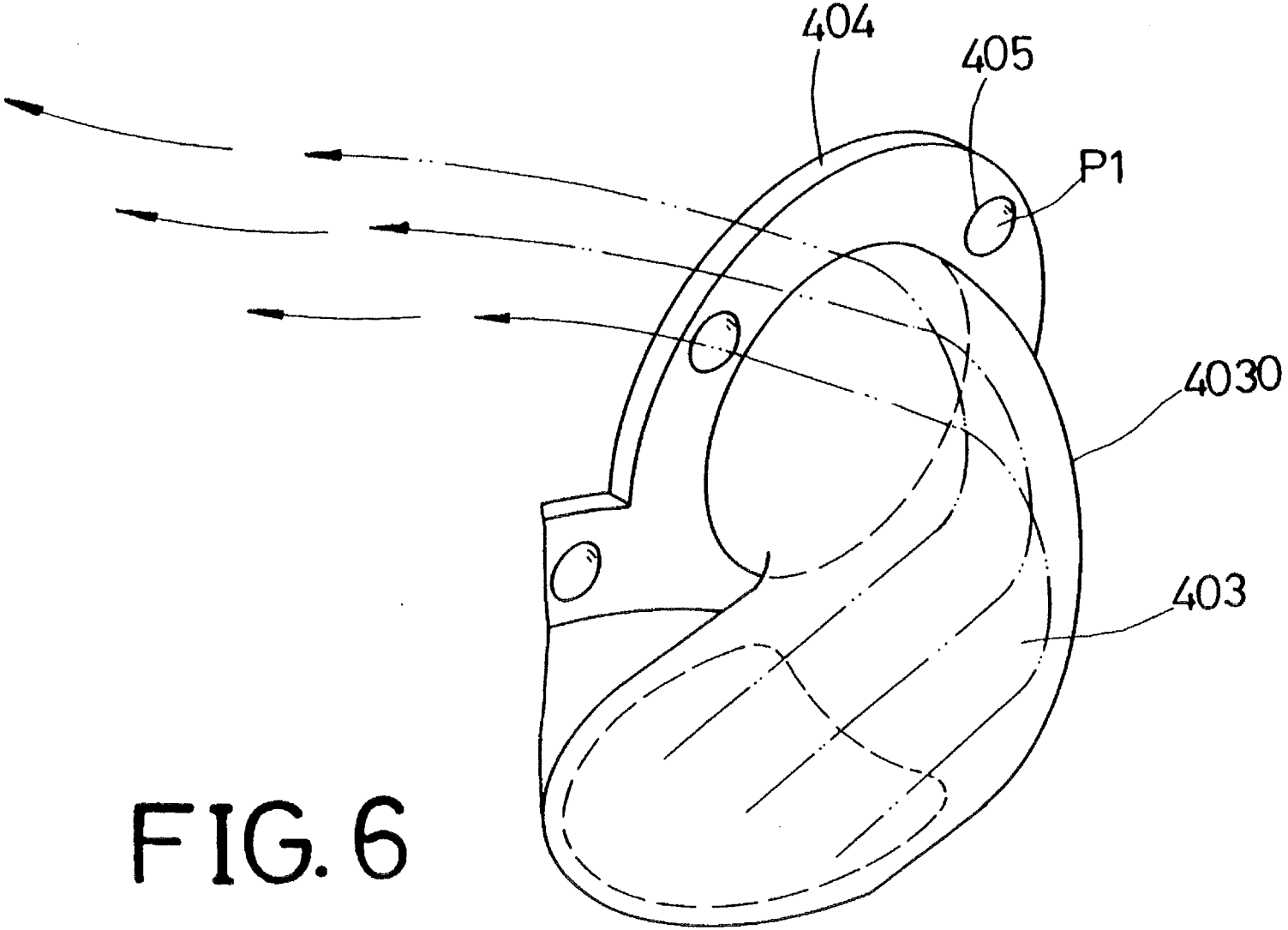
FIG. 6 is a flowing direction of the hot air current coming out of a whirlpool circulating tube of a fan housing in the roaster oven with whirlpool-circulation in the present invention.
Figure 7:
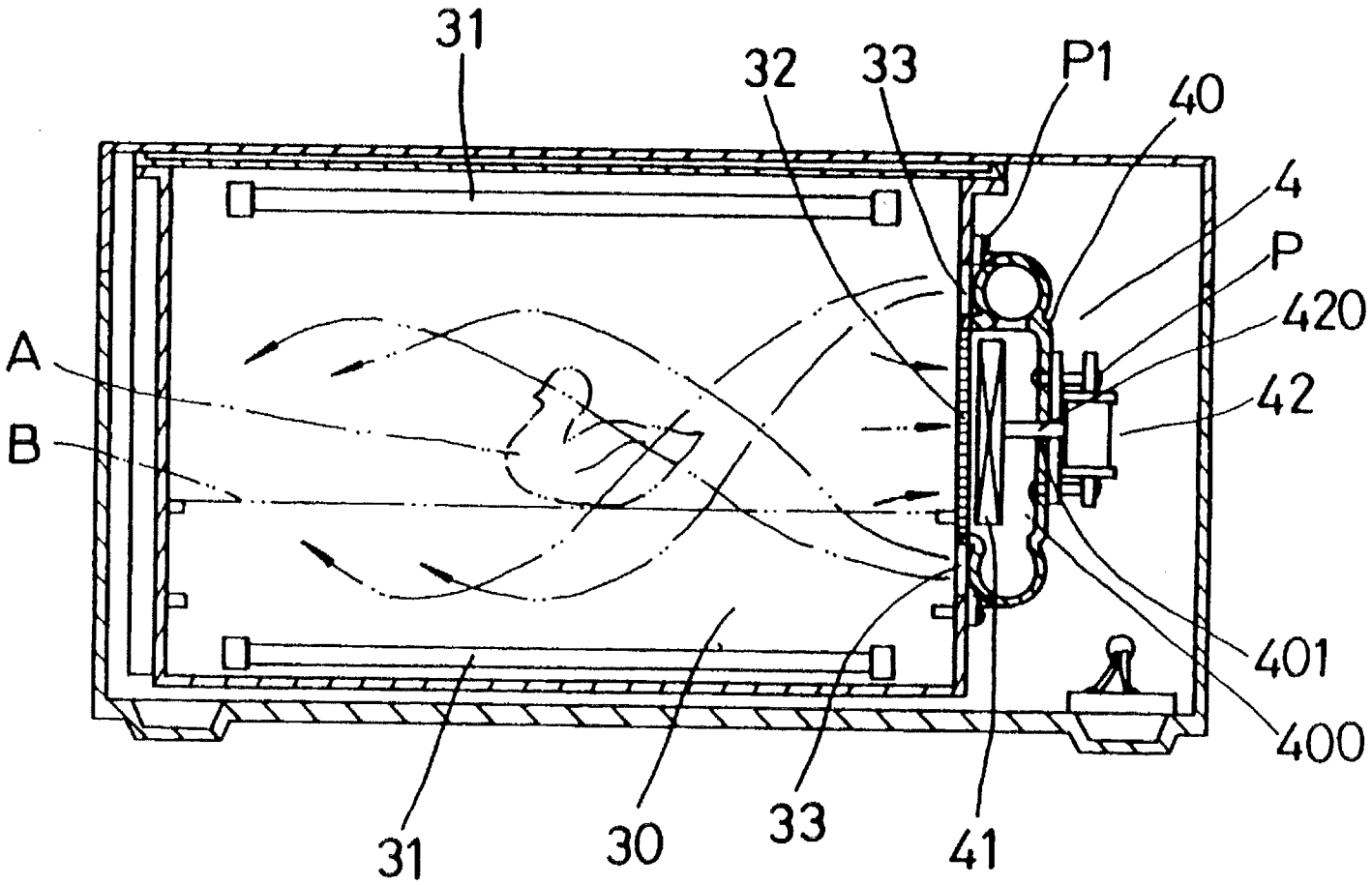
FIG. 7 is a cross-sectional view of the roaster oven with whirlpool circulation in the present invention, showing how whirlpool circulation is directed inside the oven.

In using, referring to FIGS. 5, 6 and 7, a material A to be roasted is put in the chamber 30 on a grill B and a door is closed. Then electricity is turned on to let the two electric heating tubes 31, 31 generate heat. The whirlpool circulating device 4 is also started with the fan 41 rotated to suck in hot air in the roast chamber 30 from the right side, driving hot air to flow through the air inlet 32 into the fan housing 40, with the hot air pushed by the pushing portions 4130 of every leaf 413 and flowing in the air current chamber 400 and then becoming a circulating air current between the fan leaves 413 and the air current chamber 400 by means of the encircling portions 4131, as shown in FIG. 5. Then the circulating hot air current continuously flows through the two whirlpool circulating tubes 403, 403, which have the bent portions 4030 force the hot air current to swirl like a whirlpool and then flow through the air outlets 33, 33 into the chamber 30 as whirlpool current moving around in the chamber 30, as shown in FIGS. 6 and 7. Therefore, the article A can be roasted by the hot air whirlpool current, with every part of it receiving the hot air for complete roasting as if the article A were rotated for 360 degrees during roasting.

What is claim is:

1. A roaster oven comprising:

a) an oven housing including a hollow roast chamber for containing an article to be roasted, an electric heating tube at each of an upper portion and a lower portion of the roast chamber, a front wall, an air inlet, and two air outlets in the front wall, the air outlets being positioned at an upper right side and a lower left side of the air inlet;

b) a whirlpool circulating device including a fan housing, a fan, and a power source for driving the fan;

c) the fan housing including a center air current chamber having an air opening, a bottom wall, an outer side, a center shaft hole in the bottom wall and a whirlpool circulating tube extending tangentially from each of an upper side and a lower side of the current chamber, with each circulating tube having an air opening;

d) the fan being positioned within the air current chamber and including a shaft sleeve;

e) the power source being secured on the outer side of the fan housing and including a motor, a transmitting shaft having a first end secured to the motor and a second end extending through the center shaft hole of the fan housing and secured with the shaft sleeve of the fan;

f) the air openings of the current chamber being fixed to the air inlet and the air openings of the circulating tubes being fixed to the air outlets; and g) wherein when the fan is rotated by the motor, air is blown into the roast chamber through the air inlet and heated by the electric heating tubes, with the heated air being thereafter directed through the air outlets and into the whirlpool circulating tubes from which the air is caused to circulate as a whirlpool and be redirected into the roast chamber through the air inlet for thoroughly and evenly roasting an article placed within the roast chamber.

2. The roaster oven of claim 1 wherein:

a) the fan housing includes a flange around an inner side thereof and a plurality of rivet holes spaced along the flange; and b) a plurality of rivet holes spaced around the air inlet and air outlets corresponding in location with the rivet holes of the flange for receiving rivets through the corresponding rivet holes to secure the fan housing to the oven housing.

3. The roaster oven of claim 1 wherein the fan includes a plurality of fan leaves extending radially outwardly from the shaft sleeve, and each fan leaf including a pushing portion for pushing air and an encircling portion for circulating air.

* * * * *